US005765409A

United States Patent [19]

Yang

[11] Patent Number: 5,765,409

[45] Date of Patent: Jun. 16, 1998

[54] PADLOCK HAVING A LARGE LOCK OPENING

[76] Inventor: Kuo-tsung Yang, 2nd Fl., No. 5, Alley 10, Lane 321, Hsinming Road, Taipei, Taiwan

[21] Appl. No.: 761,629

[22] Filed: Dec. 6, 1996

[51] Int. Cl.[6] ..... E05B 37/02

[52] U.S. Cl. ..... 70/28; 70/27; 70/312

[58] Field of Search ..... 70/22, 24, 27–29, 70/312

[56] References Cited

U.S. PATENT DOCUMENTS

| | | | |
|---|---|---|---|
| 546,969 | 9/1895 | Bozano | 70/29 |
| 870,890 | 11/1907 | Kruse | 70/29 |
| 970,856 | 9/1910 | Simisky | 70/29 |
| 1,117,417 | 11/1914 | Meepos | 70/29 |
| 1,168,884 | 1/1916 | Héé | 70/29 |
| 1,205,781 | 11/1916 | Piroóg | 70/28 |
| 1,486,260 | 3/1924 | Nie | 70/27 |
| 2,008,565 | 7/1935 | Segal | 70/312 |
| 4,860,561 | 8/1989 | Hwang | 70/28 |
| 5,042,277 | 8/1991 | Jenn-Rong | 70/28 |
| 5,609,048 | 3/1997 | Ling | 70/28 |

FOREIGN PATENT DOCUMENTS

| | | | |
|---|---|---|---|
| 349722 | 3/1922 | Germany | 70/29 |
| 659326 | 4/1938 | Germany | 70/28 |

*Primary Examiner*—Lloyd A. Gall
*Attorney, Agent, or Firm*—Foley & Lardner

[57] ABSTRACT

A padlock having a latch with a large field angle comprises a housing combined by a pair of opposed casings, a latch disposed within the pair of opposed casings, a pushing block for driving the latch to rotate, and a number selecting device for controlling the pushing block to be shifted. When the number selecting device is selected to a correct number sequence, the pushing block is permitted to be pushed into the casings to drive the latch to pivotally retract within the housing. Thereby, the latch can be opened in a large field angle to facilitate the use of the padlock.

3 Claims, 5 Drawing Sheets

PADLOCK HAVING A LARGE LOCK OPENING

FIELD OF THE INVENTION

The present invention relates to a padlock, and more particularly to a padlock having two correspondingly mated covers and a latch movably received therebetween.

DESCRIPTION OF RELATED ART

A conventional padlock is shown, for example, in FIG. 6. The padlock includes a casing 80, an arcuate latch 81 integrally formed and extending from a first end of the casing 80 and a retaining rod 82 extending oppositely to the latch 81 and movably retained on a second end of the casing 80. A plurality of numbered wheels 83 are arranged within the casing 80 and a pushing block 84 is movably mounted to one side of the casing 80. When each correct number on the numbered wheels 83 is selected in predetermined series, the pushing block 84 is then permitted to slide along the side of the casing 80 and drive the retaining rod 82 to shift, thereby one object to perform a locking function of the padlock will be easily completed by the reciprocation movement of the retaining rod 82 relative to the arcuate latch 81. Referring to FIG. 7 and FIG. 8, cross-sectional views of the conventional padlock are shown. The retaining rod 82 has a head 820 pivotedly mounted within the casing 80. A protrusion 821 extends from the head 820. The numbered wheels 83 are rotatably mounted on a rod 85. The rod 85 has a collar 850 at one end thereof. A hook 851 extends from the collar 850 to urge against the protrusion 821 of the retaining rod 82. The pushing block 84 has a protruding block 840 extending from one end thereof to be retained at the end of the rod 85. With the above arrangement, the numbered wheels 83 are each respectively selected in a predetermined number sequence. The pushing block 84 is allowed to slidably move on the rod 85. The hook 851 of the rod 85 will thus drive the protrusion 821 and force the retaining rod 82 to pivot, thereby, allowing a space (not numbered) to be defined between the latch 81 and the retaining rod 82 for locking objects.

The above mentioned structure of the padlock of the invention suffers from a disadvantage which is that the space defined between the latch 81 and the rod 82 is so limited that a user will have to pay close attention when hooking the padlock around an object, particularly a large object.

The present invention provides an improved padlock having a latch with a large opening angle to mitigate and/or obviate the aforementioned problems.

SUMMARY OF THE INVENTION

One object of the present invention is to provide a padlock having an arcuate latch with a large opening angle in order to facilitate the use of the padlock.

In accordance with one aspect of the present invention, the padlock having a latch with a large moving angle comprises a pair of oppositely but correspondingly mated casings, a latch movably disposed within the pair of opposed casings, a pushing block also movably received within the casing, and a number selecting means for controlling the pushing block to be shifted.

In accordance with another aspect of the present invention, the pair of opposed casings defines a cavity at a lower corner of one side thereof, a notch at a top portion thereof and a pair of through-holes at both of two side walls defining the notch for the latch to extend therethrough. One of said opposed casings has a boss and a pillar extending from an inner wall thereof for the latch and a torsional spring to be respectively mounted thereon. The latch is configured as a rod extending from the through-holes of the notch and has an arm extending from one end thereof. A hole is defined in the arm to receive the boss therein and the arm further has a stop and a retainer integrally formed with and respectively extending from a periphery defining the hole. The pushing block is substantially configured as an "L" shape and includes a vertical portion and a horizontal portion. The vertical portion is exposed by the cavity of the casings so that it may be pushed by a user. The vertical portion has a rod extending from an inner face thereof, and on the rod a spring and the number selecting means are sequentially mounted. The horizontal portion defines a recess thereon for mating with the stop of the latch and driving the latch to pivot downwardly toward the cavity.

In accordance with a further aspect of the present invention, one of the opposed casings transversely defines a slot at the inner side face thereof for receiving an elastic sheet therein. The elastic sheet is configured to have a plurality of formations extending downwardly to locate the number selecting means.

In accordance with still a further aspect of the present invention, one of the opposed casings further has a protrusion extending from an inner face thereof. The horizontal portion of the pushing block defines a groove to mate with the protrusion therein in order to limit the displacement range of the pushing block.

Other objects, advantages and novel features of the invention will become more apparent from the following detailed description when taken in conjunction with the accompanying drawings.

DETAILED DESCRIPTION OF PREFERRED EMBODIMENT

Figure 1:
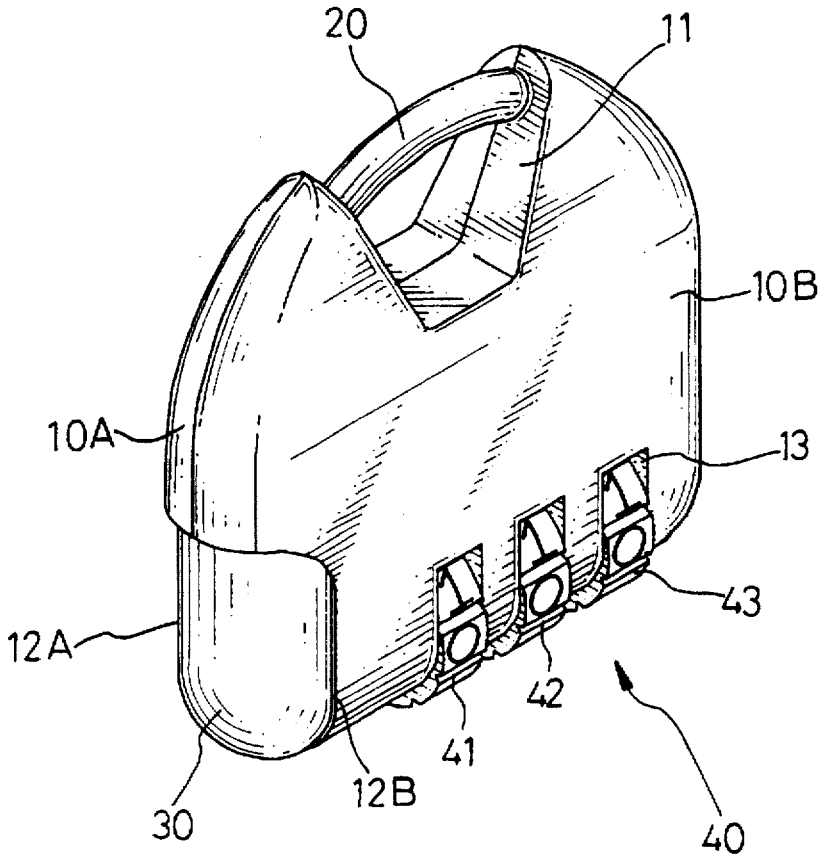
FIG. 1 is a perspective view showing a padlock having a latch constructed in accordance with the present invention.

Referring to FIG. 1, the padlock constructed in accordance with the present invention includes a housing(not numbered) combined with a pair of opposed casings 10A, 10B. The opposed casings 10A, 10B each defines a notch 11 at a top portion thereof and a cavity 12A, 12B at a lower corner at one side thereof, wherein the cavities 12A, 12B defines an entrance (not numbered) in the combination of the opposed casings 10A, 10B. A latch 20 is movably mounted across the notch 11. A pushing block 30 is movably situated within the cavities 12A, 12B. A number selecting means 40 is securely received within a space (not shown) of the opposed casings 10A and 10B of the padlock for controlling movement of the pushing block 30. In this embodiment, the number selecting means 40 is designed to have three numbered wheels 41, 42 and 43 partly exposed from the casings 10A and 10B at three corresponding gaps 13 defined by the casings 10A, 10B.

Figure 2:
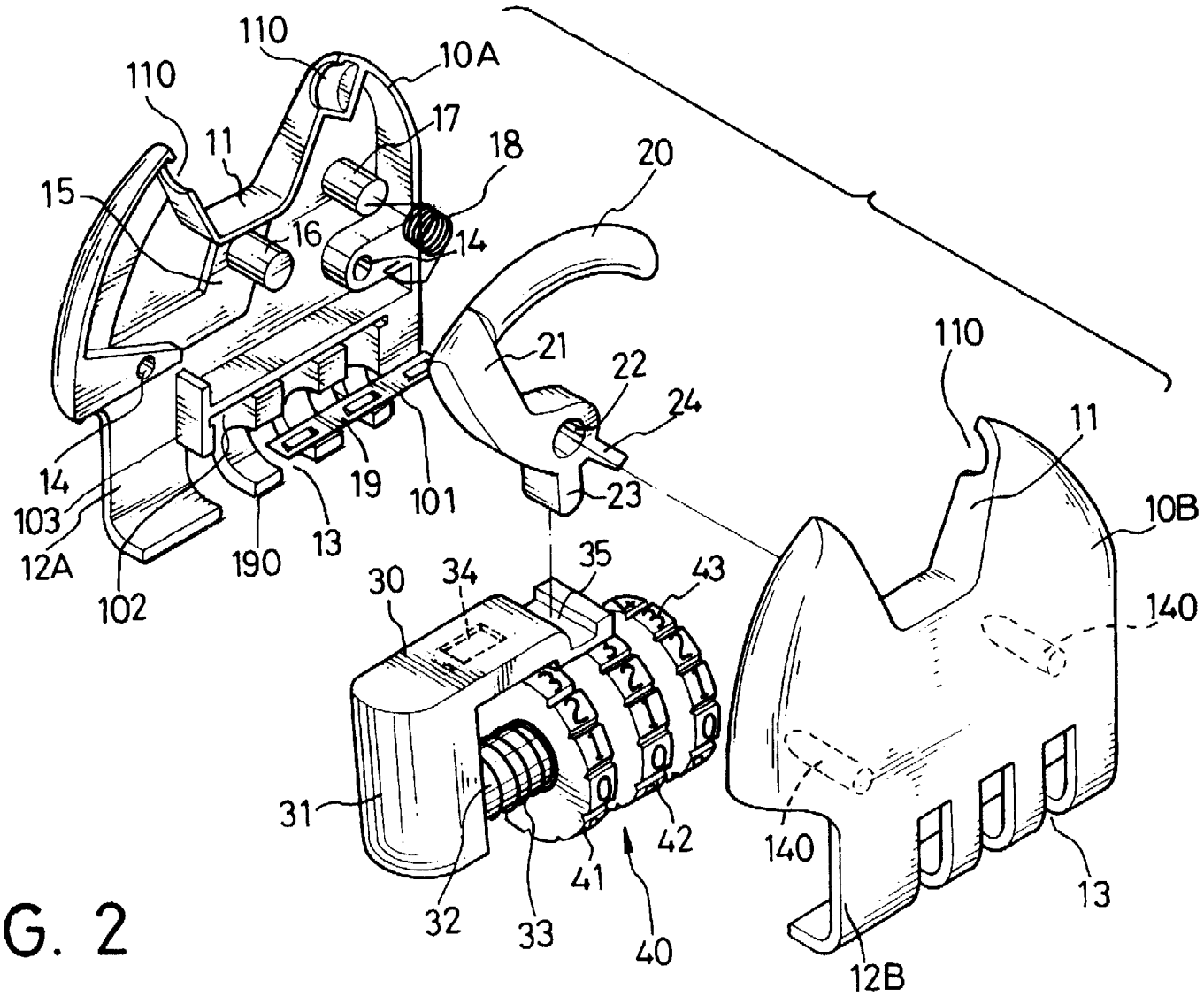
FIG. 2 is an exploded view showing the padlock in accordance with the present invention.

The detailed elements of the padlock in accordance with the present invention will be apparently seen with a reference to FIG. 2, which shows an exploded view of the padlock. Each casing 10A, 10B defines a pair of half-round holes 110 at both of two side walls defining the notch 11 and a semicircular hole (not numbered) at a lower corner of a side opposite to the side with the entrance 12 thereof, wherein the semicircular holes define an opening 101 in the combination of the casings 10A, 10B.

Figure 3:
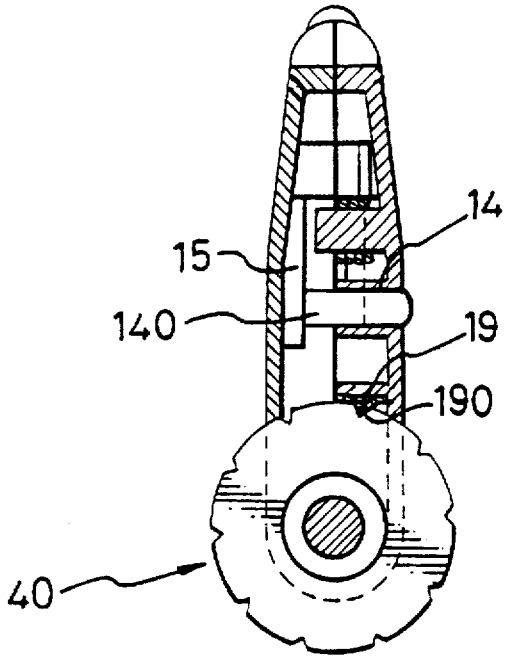
FIG. 3 is a cross-sectional view along 3—3 of FIG. 5, showing the padlock in accordance with the present invention.
Figure 6:
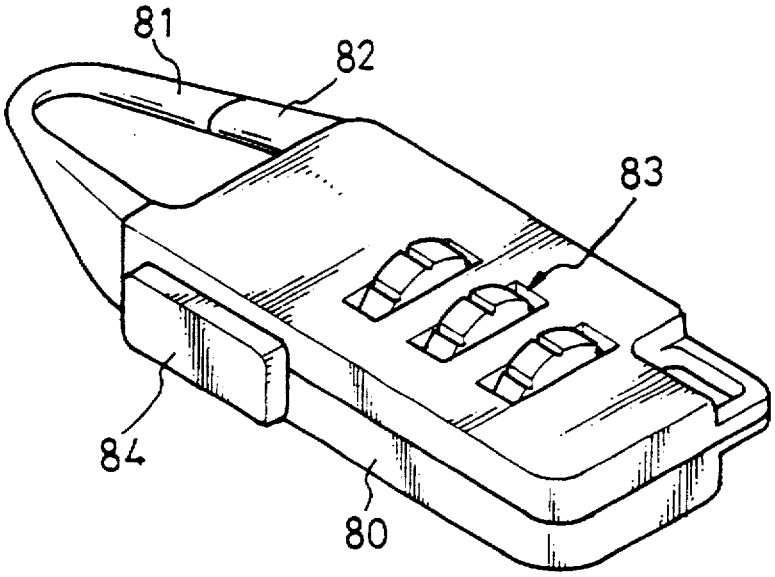
FIG. 6 PRIOR ART
FIG. 6 is a perspective view showing a conventional padlock.

A pair of posts 140 are provided at an inner face of the casing 10B and a pair of blind holes 14 corresponding to the posts 140 are provided at an inner side face of the casing 10A so that the opposed casings 10A, 10B can be engaged with each other, as shown in FIG. 3.

A pad 15 is integrally formed on the inner face of the casing 10A, extending from the bottom of the notch 11 to one of the blind holes 14. A boss 16 extends from an appropriate position on the pad 15 and engages with the latch 20. With the presence of the pad 15 and the boss 16, the latch 20 will not be in contact with the inner face of the casing 10A and can extend through the holes 110. A pillar 17 extends from an appropriate position of an inner face of the casing 10A and engages with a torsional spring 18. A slot 102 is transversely defined above the gaps 13 at the inner face of the casing 10A for an elastic sheet 19 to be received therein. The elastic sheet 19 is formed to have, for example, three formations 190 extending downwardly to be correspondingly received in a space (not numbered) defined by each numbered wheel 41, 42, 43, as shown in FIG. 3. The casing 10A further has a "T" shaped configuration 103 extending over an upper portion of the slot 102.

The latch 20 is configured to have an arcuate shape. The latch 20 has an arm 21 extending from one end thereof. The arm 21 has a head (not numbered) defining a hole 22 through which the boss 16 of the casing 10A extends. The head further has a stop 23 and a retainer 24 respectively extending from an outer periphery of the head. The stop 23 is provided to facilitate the shifting movement of the pushing block 30, and the retainer 24 is provided to be abutted by the torsional spring 18.

The L-shaped pushing block 30 includes a vertical portion 31 disposed within the cavity 12A and 12B of the housing, so that a user may push the pushing block 30 into the casings 10A, 10B. A rod 32 integrally formed with the pushing block 30 extends from an inner face of the vertical port-on 31 (see FIG. 4) for a spring 33 and the numbered wheels 41, 42, 43 to be sequentially mounted thereon. When the user selects a predetermined correct number sequence with the numbered wheels 41, 42, 43, the rod 32 driven by the vertical portion 31 is permitted to move to the number selecting means 40. A horizontal portion (not numbered) of the pushing block 30 defines a groove 34 on a bottom face thereof, such that the groove 34 is able to be retained by the "T" shape protrusion 103 of the casing 10A, thereby limiting displacement of the pushing block 30. A recess 35 is defined at a rear portion of the horizontal portion and mate with the stop 23 of the latch 20, such that when a user pushes the pushing block 30, the latch 20 will travel towards the cavity due to the mating of the recess 35 and the stop 23, and thus the latch 20 will leave the furthermost hole 110 of the casings 10A, 10B.

Figure 4:
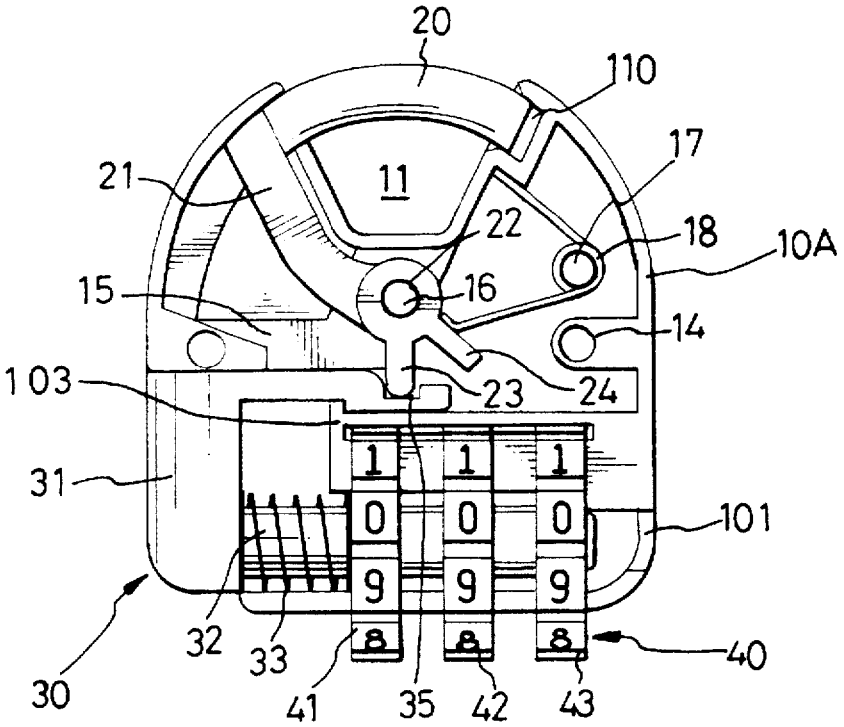
FIG. 4 is a front view showing the padlock in accordance with the present invention, with one of two casings removed for clarily.
Figure 5:
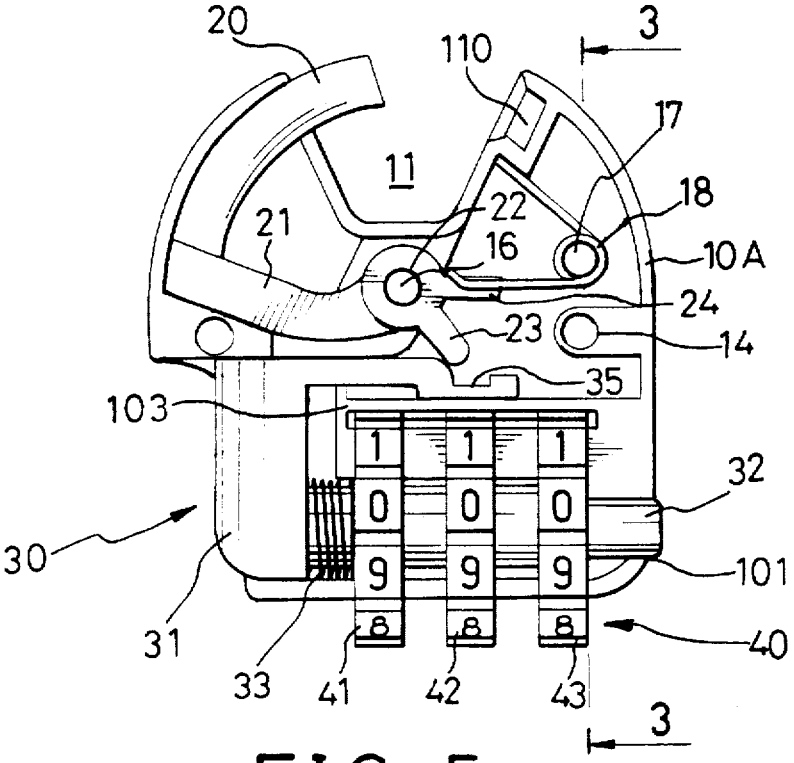
FIG. 5 is a front view showing the operation of the padlock in accordance with the present invention, with one of two casings removed for clarity.
Figure 7:
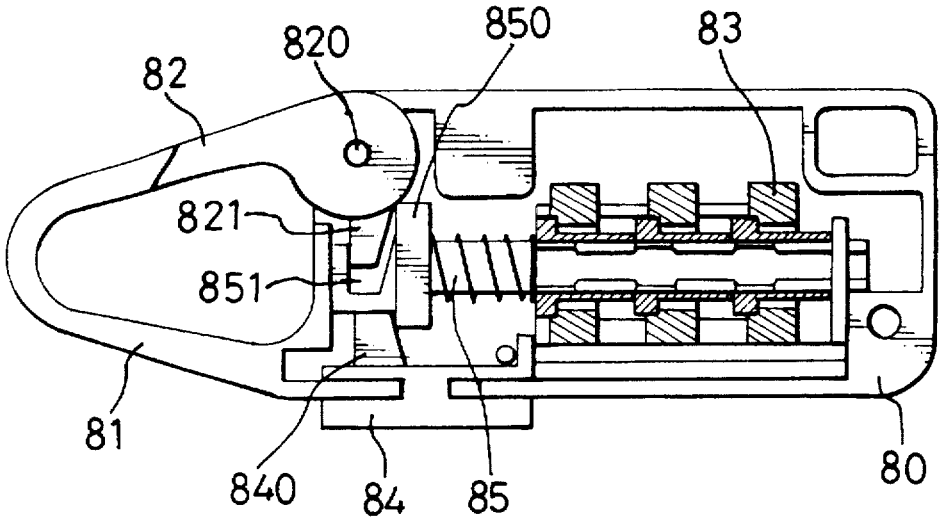
FIG. 7 PRIOR ART
FIG. 7 is a plane view showing the conventional padlock of FIG. 6.
Figure 8:
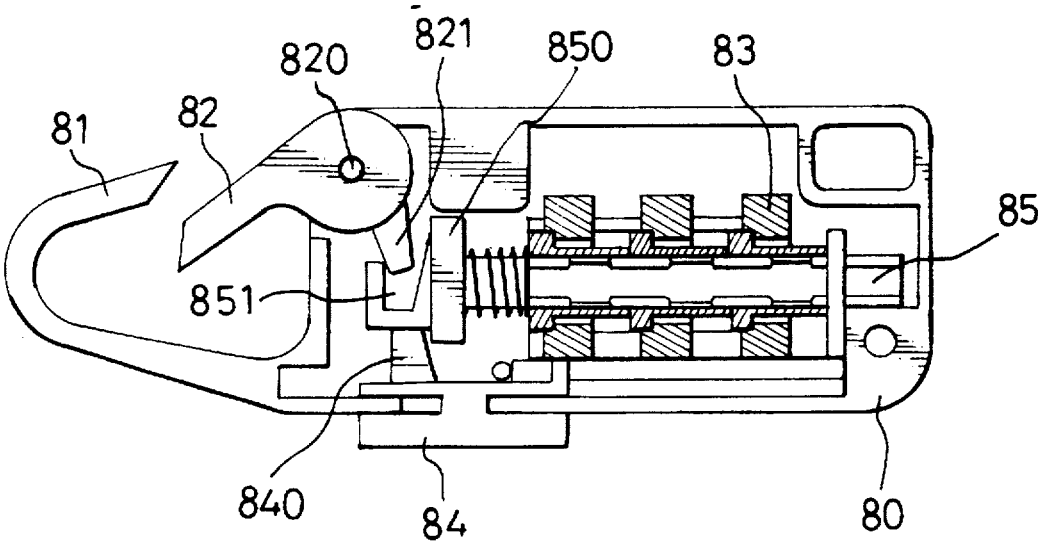
FIG. 8 PRIOR ART
FIG. 8 is a schematic view showing the operation of the padlock of FIG. 6.

FIG. 4 shows a front view of the operation of the padlock in accordance with the present invention, with the casing 10B removed for clarity. When the padlock is in a closed status, the vertical portion 31 of the pushing block 30 is urged by the spring 33 into the cavity 12. Also, the arm 21 of the latch is not shifted by the pushing block 30, therefore it extends over the notch 11 of the casing 10. When the user first selects the number wheels 41, 42, 43 to a correct number sequence, and then pushes the vertical portion 31 of the pushing block 30 into the casings 10A, 10B, as shown in FIG. 5, the rod 32 moves into the selection means 40, with its free end exposed from the opening 101 defined by the semicircular holes of the casings 10A, 10B. The recess 35 on the horizontal section of the pushing block 30 will drive the stop 23 of the latch 20 to pivot towards the pushing block 30. Thereby the latch 20 is pulled back from the furthermost hole 110 of the notch 11 with a large field angle till it abuts the post 140. In practice, a distance between a distal tip of the latch 20 and the furthermost hole 110 is about 12 millimeters so that it is convenient for the padlock to be used. After the objects to be locked are arranged within the notch 11, the vertical portion 31 of the pushing block 30 is released to its closed state.

Accordingly, the present invention is designed such that a large field angle will be defined when the latch 20 is retracted to within the housing. Also, the pushing block is designed to be easily pushed by a thumb of the user.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A padlock having a latch with a large field angle, comprising a pair of opposed casings, a latch disposed within the pair of opposed casings, a pushing block for driving the latch to pivot and a number selecting means controlling the pushing block to shift, wherein said pair of opposed casings are combined to define a cavity at a lower corner of one side of the combination of the casings, a notch at a top portion thereof and a pair of through-holes at both of two side walls defining the notch for the latch to extend therethrough, one of said opposed casings has a boss and a pillar extending from an inner wall thereof for the latch and a torsional spring to be mounted respectively thereon; and said latch is formed as a rod extending from the through-holes of the casings and has an arm extending from one end thereof, said arm defines a hole therein to receive the boss of the casing and has a stop and a retainer respectively extending from a periphery defining the hole, and said pushing block has a vertical portion and a horizontal portion, the vertical portion being exposed by the cavity of the casings for being pushed by the user in a direction toward the number selecting means, the vertical portion having a rod extending from an inner face thereof on which a spring and the number selecting means are sequentially set, the horizontal portion defining a recess therein for mating with the stop of the latch and driving the latch to pivot in a direction toward the cavity.

2. A padlock having a latch with a large field angle as claimed in claim 1, wherein one of the opposed casings transversely defines a slot at an inside face thereof for receiving an elastic sheet, said elastic sheet being formed with a plurality of formations extending downwardly to locate the number selecting means.

3. A padlock having a latch with a large field angle as claimed in claim 1, wherein one of the opposed casings further has a protrusion extending from an inner face thereof, and wherein the horizontal portion of the pushing block thereon defines a groove mating with the protrusion in order to limit the displacement range of the pushing block.

* * * * *